US007955196B2

(12) United States Patent
Constant

(10) Patent No.: US 7,955,196 B2
(45) Date of Patent: Jun. 7, 2011

(54) BATTING TRAINING DEVICE AND METHOD

(76) Inventor: James Sam Constant, South Daytona, FL (US)

( * ) Notice: Subject to any disclaimer, the term of this patent is extended or adjusted under 35 U.S.C. 154(b) by 1638 days.

(21) Appl. No.: 10/324,070

(22) Filed: Dec. 20, 2002

(65) Prior Publication Data

US 2004/0121861 A1 Jun. 24, 2004

(51) Int. Cl.
*A63B 69/00* (2006.01)

(52) U.S. Cl. ..... 473/451; 473/422; 473/453

(58) Field of Classification Search ..... 473/422, 473/451, 423–431, 453, 417; 273/348, 410, 273/407, 343

See application file for complete search history.

(56) References Cited

U.S. PATENT DOCUMENTS

| | | | | | |
|---|---|---|---|---|---|
| 720,406 | A | * | 2/1903 | Clifford | 473/265 |
| 3,166,317 | A | * | 1/1965 | Tumelson | 473/430 |
| 3,386,733 | A | * | 6/1968 | Russo et al. | 473/453 |
| 3,475,026 | A | * | 10/1969 | Cooper | 473/430 |
| 3,940,131 | A | | 2/1976 | St. Claire, Jr. | |
| 4,176,838 | A | | 12/1979 | Griffin | |
| 4,227,691 | A | * | 10/1980 | Lefebvre et al. | 473/417 |
| 4,295,648 | A | * | 10/1981 | Stromback | 473/456 |
| 4,451,036 | A | * | 5/1984 | Sinclair et al. | 473/453 |
| 4,456,250 | A | | 6/1984 | Perrone, Jr. | |
| 4,516,771 | A | | 5/1985 | Nau | |
| 4,577,864 | A | | 3/1986 | Aldrich | |
| 4,629,188 | A | * | 12/1986 | Mahieu | 473/454 |
| 4,664,375 | A | * | 5/1987 | Tetreault | 473/429 |
| 4,709,924 | A | | 12/1987 | Wilson et al. | |
| 4,768,785 | A | | 9/1988 | Patterson | |
| 4,819,937 | A | | 4/1989 | Gordon | |
| 4,898,385 | A | | 2/1990 | Love | |
| 4,938,478 | A | | 7/1990 | Lay | |
| 4,956,881 | A | * | 9/1990 | Lindley et al. | 4/517 |
| 5,004,234 | A | | 4/1991 | Hollis | |
| 5,040,791 | A | | 8/1991 | Ratajac et al. | |
| 5,106,085 | A | * | 4/1992 | Lewy | 473/417 |
| 5,282,615 | A | * | 2/1994 | Green et al. | 473/418 |
| 5,338,037 | A | * | 8/1994 | Toyohara | 473/268 |
| 5,348,291 | A | * | 9/1994 | Scully | 473/454 |
| 5,511,775 | A | * | 4/1996 | Parks | 473/454 |
| 5,513,842 | A | * | 5/1996 | Fuss | 473/263 |
| 5,516,115 | A | * | 5/1996 | McLain | 473/417 |
| 5,833,549 | A | | 11/1998 | Zur et al. | |
| 6,238,307 | B1 | | 5/2001 | Owen | |
| 6,343,998 | B1 | * | 2/2002 | Tarulli et al. | 473/273 |
| 6,435,990 | B1 | * | 8/2002 | Bradley | 473/453 |
| 6,458,041 | B1 | * | 10/2002 | Brandt | 473/268 |
| 6,780,122 | B2 | * | 8/2004 | Belanger | 473/257 |
| 2003/0224880 | A1 | * | 12/2003 | Hansberry | 473/430 |

* cited by examiner

*Primary Examiner* — Mitra Aryanpour
(74) *Attorney, Agent, or Firm* — Bacon & Thomas, PLLC

(57) ABSTRACT

Apparatus and method for teaching a batter to swing a bat in a premeditated plane to and through an invisible target that simulates the point of contact where a round bat will meet and greet a round ball squarely. A batter's training tool that facilitates a batter to swing a bat with finesse, confidence, accuracy, speed and strength. Through repeated practice, the batter becomes physically and psychologically habituated to maintain the correct swing form for improved contact.

4 Claims, 4 Drawing Sheets

BATTING TRAINING DEVICE AND METHOD

BACKGROUND AND BRIEF DESCRIPTION OF THE INVENTION

There are number of prior art batting training apparatuses and methods including batting "T"s (see Owen U.S. Pat. No. 6,238,307 as an example), tethered balls (see the tethering arrangement shown in Ratajac et al U.S. Pat. No. 5,040,791 as an example), optical bat path-determining systems (see Zur et al U.S. Pat. No. 5,833,549 as an example) and there are numerous other systems devised to enhance the batting capabilities of ball players (baseball and softball).

The present invention provides an apparatus and methods for improving the batting skills of a ball player. The batting training tool and method of the invention facilitates a batter to swing a bat with finesse, confidence, accuracy, speed and strength. Through repeated practice, using the apparatus and method disclosed herein, the batter becomes physically and psychologically habituated to maintain the correct swing form for improved ball contact. Thus, the present invention uniquely enhances, simplifies and accelerates the intended ultimate basic, fundamental learning process, achieving the desired result of mastering a controlled, correct and deliberate swing for improved ball contact in the strike zone.

The apparatus of the invention includes a ground-engaging frame member and a pair of flexible members supported by the frame member a predetermined distance apart (preferably in the neighborhood of about four inches) defining a predetermined swing path which includes the strike zone. The pair of flexible members have dangling ends. The pair of dangling ends define the upper bounding plane of an invisible bat target path whereby through repeated practice swings, the batter's head is physically trained to stay virtually still, keeping the batter's eyes on the ball from the pitcher's mound to the strike zone; thereby establishing muscle memory of the proper swing mechanics. In one embodiment, the apparatus includes a batting "T" positioned intermediate the pair of flexible members having a ball supporting surface (with no ball thereon) defining a lower bounding plane of the invisible batting target path.

The invention includes a method of teaching a batter to swing a bat in a preselected plane and through a predetermined invisible bat target plane that simulates the point of contact for a ball bat and greet a round ball squarely. The predetermined invisible batting target plane is defined by dangling ends of a pair of flexible members and a point intermediate the pair of flexible members defined by the top of a batting "T", for example, whereby, through repeated practice swings, the batter's head is physically trained to stay virtually still, keeping the batter's eyes on the ball to thereby establish muscle memory of the proper swing mechanics.

In a preferred embodiment, the ground-engaging support frame has a base that is horseshoe shaped so that it has a fall-away safety feature, namely, if the top of the apparatus is struck accidentally with a bat, the L-shaped bracket will spin and the apparatus will fall backwards. Another feature of the invention is that the ground-engaging support member is adjustable to adjust the height of the invisible bat target path to adjust for different swing heights and size batters. Moreover, the flexible members may be constituted by a single flexible rope passing through and supported by a rigid tube member which defines the spacing between the ends of the flexible members. The ends of the flexible members are soft and pliable but are designed to maintain their integrity because it can be expected that they will be hit many times by practicing batters. Thus, the ends of the flexible members may be treated to maintain their integrity, and thereby extend the life thereof.

The present invention, through repeated practice, will train the athlete to maintain his head virtually still, keeping his eye on the ball; all this without effort. The present invention teaches the batter the value of balance—before, during and after the swing. It will also teach the batter concern for bat speed versus brute force for enhancement of the athlete's batting average and enjoyment of the game.

DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
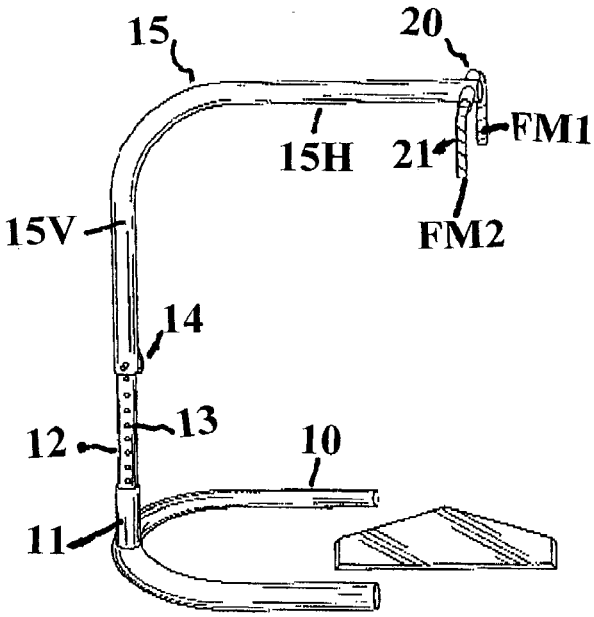
FIG. 1 is an isometric view of the apparatus of this invention on the opposite side of home plate of a practicing batter.
Figure 2:
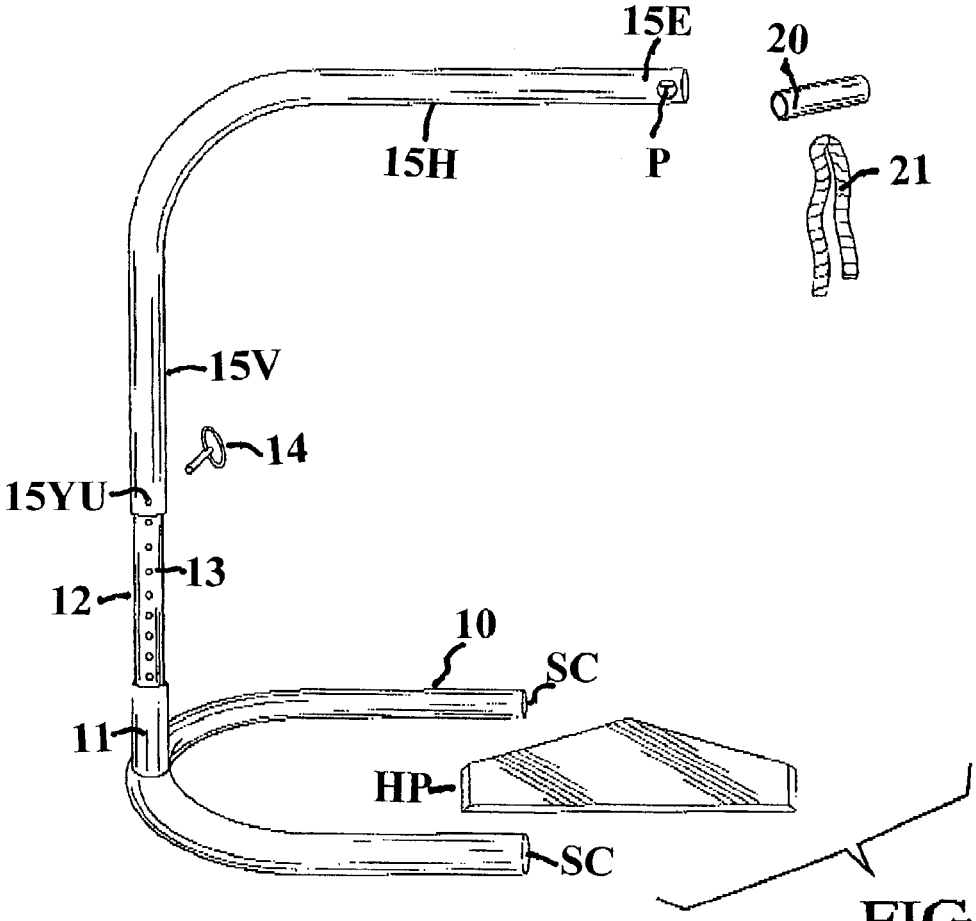
FIG. 2 is an exploded view of the apparatus shown in FIG. 1.

It has been emphasized from the outset that to achieve the maximum benefit of the present invention, the idea is to train the batter to keep his head still and an eye on the "ball" (a baseball in this embodiment); except in the present apparatus and training method, there is no baseball. The swing path is defined by the dangling ends of a pair of flexible members spaced a predetermined distance apart. Referring now to FIGS. 1 and 2, an enclosed capped, U-shape style tubular base member 10 having an attached vertical female stud 11 located directly in the middle of the U-shaped base 10 and perpendicular thereto. The female stud 11 holds a cylindrical straight tube 12 which can be provided in variable lengths to fit the needs and demands of the practicing athlete. At the same time, the inner cylinder 12 houses a number of spaced holes 13 to accommodate adjustments for the variation of the batter's strike zone.

The L-shaped tube 15 has a vertical member 15V and a horizontal member 15H. The vertical member 15V telescopes over the inner tube 12 as illustrated and described earlier while the horizontal member or portion 15H has an outer end 15E which has a pair of aligned perforations or holes P. Upon insertion, the lower end of 15V telescopically receives the upper end of inner tube or cylinder 12, and a carterless hitch-pin 14 passes through aligned hole 15YU and one of holes 13 according to the desired height of adjustment. It will be appreciated that the degree of adjustment can be modified to accommodate different batters' heights and desires.

Seal caps SC are provided in the ends of the tubular U-frame member 10 and 15 to prevent the egress of water and dirt.

Although not critical, it should be noted that the end 15E and the perforations P extend beyond the ends of the U-shaped base frame member 10, and in the illustration of FIG. 1, the home plate HP positioned with the diamond end of the batter's plate or home plate is positioned such that the perforations P are approximately in a line with the fore and aft direction of home plate HP.

Referring now particularly to FIG. 2, a tubular member 20 has a flexible member 21 passed therethrough and which has ends FM1, FM2 which freely dangle or hang out the ends of tubular member 20. Tubular member 20 is a removable plastic tube of variable lengths. Since it is likely plastic tube 20 will be hit many times by the bats of errant batters, it is replaceable. For applicant's intended purposes, four inches is recommended but the invention is not limited to this specific dimension. This dimension essentially defines the distance between the ends of the rope or flexible member 21 which is passed through tubular member 20 and has the ends thereof dangling down to define an invisible target swing path ISP. Tubular member 20 supports the flexible members FM1 and FM2 in a predetermined orientation relative to each other. It will be appreciated that in various batting training exercises, the ends of the flexible members need not be coplanar to each other or to the ground. It is desirable for customary training exercise for the batter to swing slightly downwardly and thus the upstream dangling flexible member is slightly higher than the downstream flexible member (the terms "upstream" and "downstream" reflecting the direction of movement of the bat relative to the ends of the flexible dangling members). The flexible dangling members create an arch effect, and the front member FM1 of the arch or upstream end of the arch is opposite the stance of the batter. Hence, while facing the apparatus, a right-handed batter will place the left strand of a rope directly over, yet spaced wide enough for the batter's bat to pass uninterrupted through the batting zone. By "uninterrupted," it is intended to mean that the batter is being trained to avoid hitting the dangling ends of the flexible member and pass just beneath them.

Figure 3:
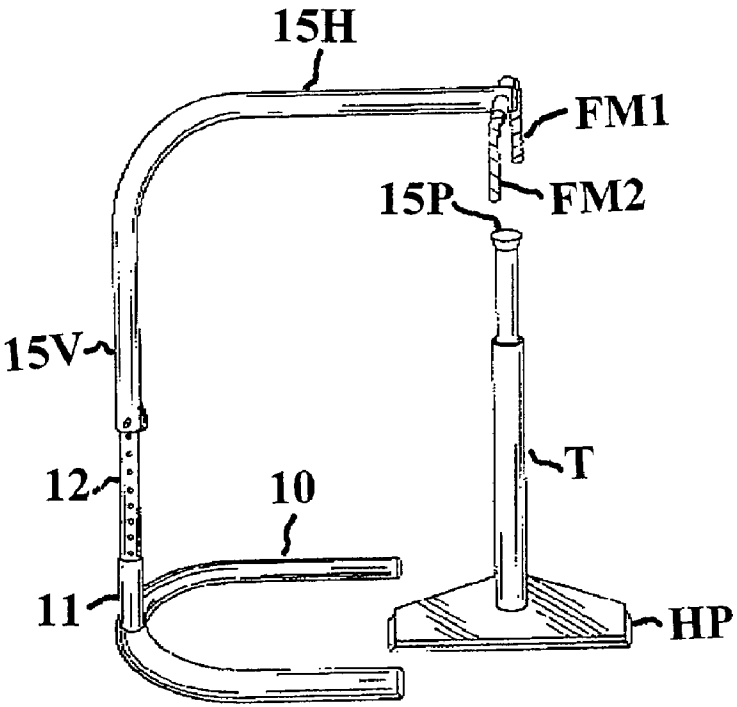
FIG. 3 is a perspective view of an embodiment of the invention showing in juxtaposition thereof a conventional adjustable batting "T"

In this connection, when the invisible swing path is further defined by the use of the batting "T" (FIG. 3), the ball support member of the batting "T" is positioned between the two dangling ends and just below the distance normally occupied by a ball (not shown). The flexible members FM1 and FM2 can be adjusted to predetermined distances to establish a desired invisible plane of the swing. No ball is used.

Figure 5:
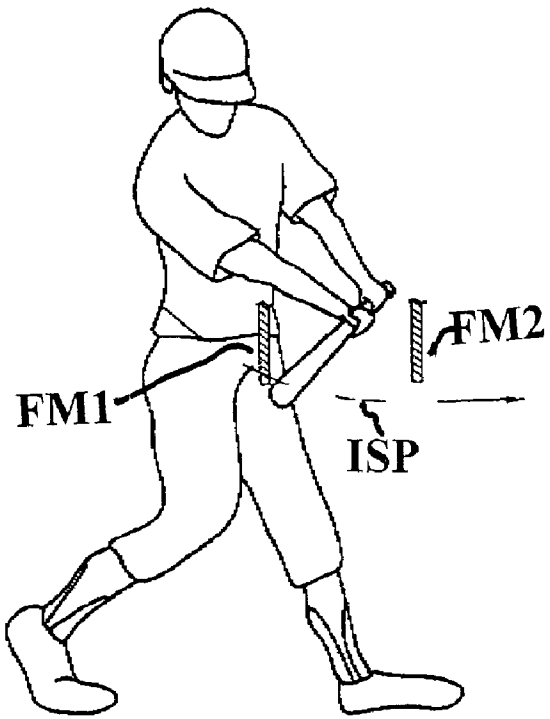
FIG. 5 is an illustration of the position of the dangling flexible members or ropes with the suspension or mounting apparatus deleted.
Figure 4:
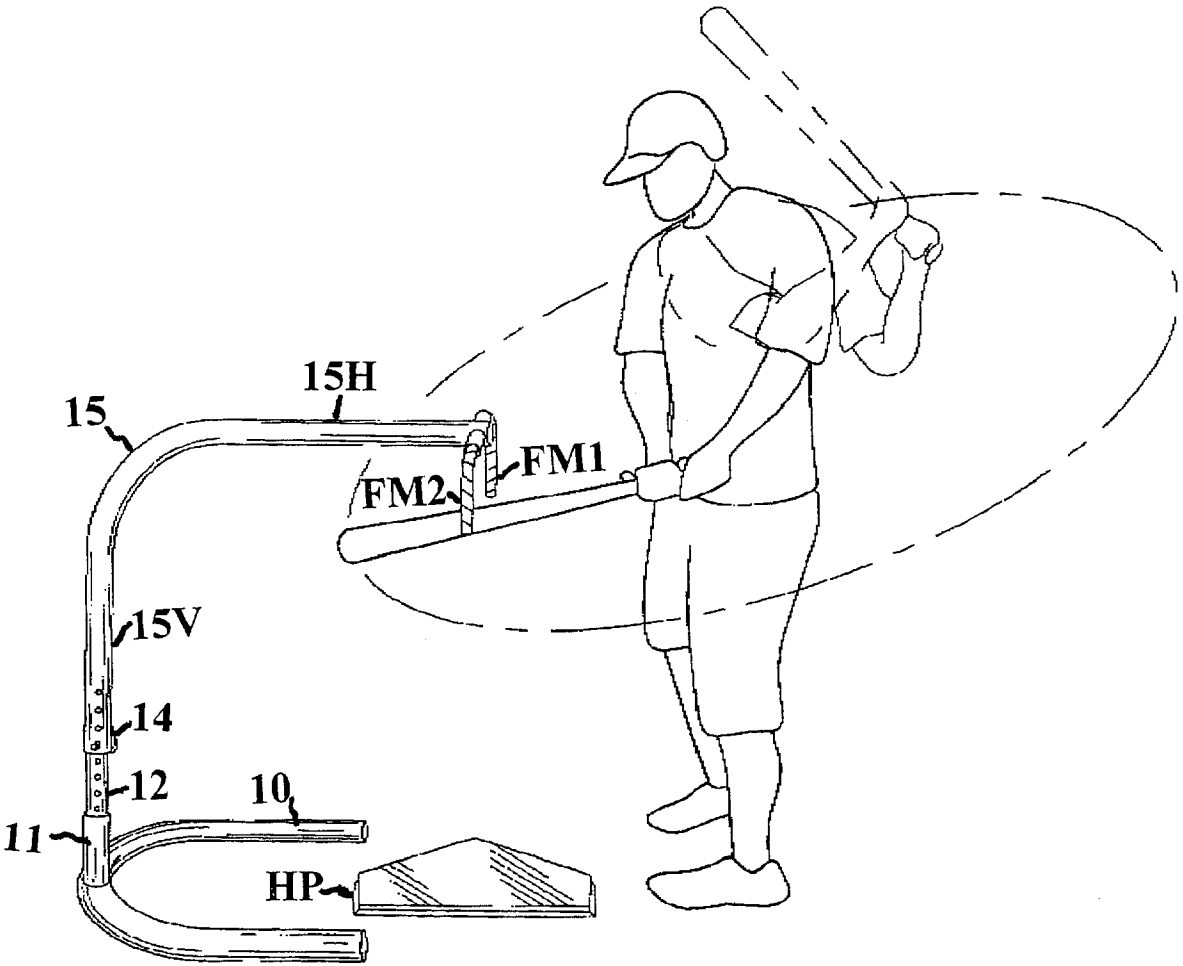
FIG. 4 is a perspective view illustrating the position of a batter relative to the apparatus of this invention.
Figure 8:
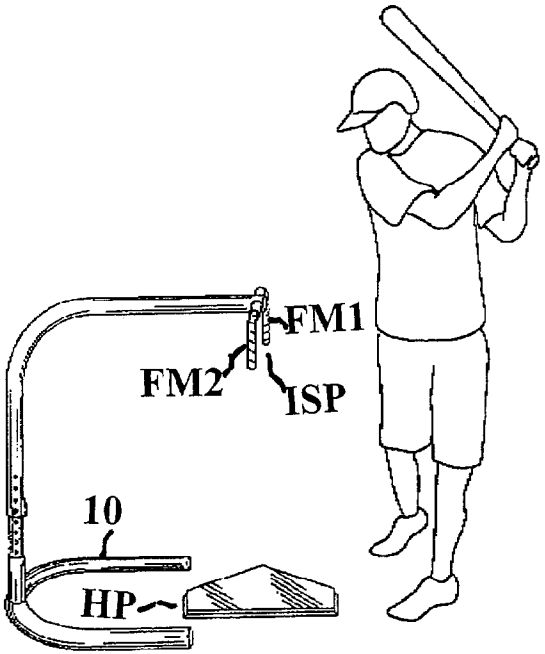
FIG. 8 is the follow-through illustrating that the batter has made contact and follow-through and his head, eyes and body are prepared in the shortest amount of time to get to first base.
Figure 7:
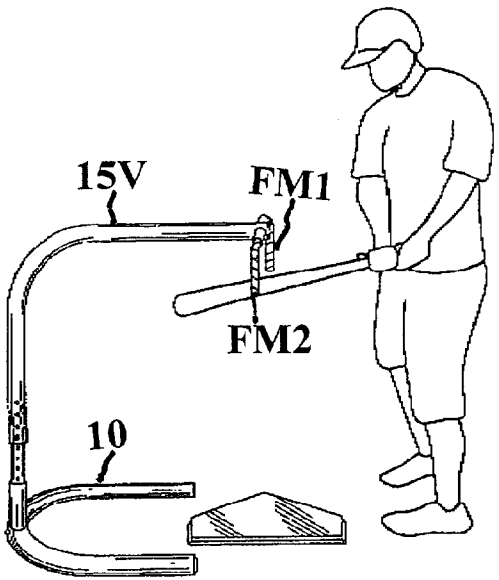
FIG. 7 is a further illustration showing the swing of the batter; the imaginary "pitch" is on its way and the batter is following the ball with his eyes right into the strike zone and going for it.
Figure 6:
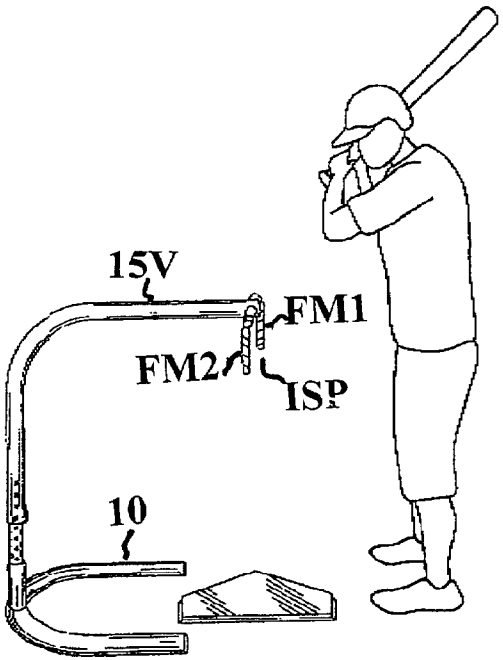
FIG. 6 illustrates a batter standing in a batter's box with his head properly oriented and his eyes trained over towards the pitcher's mound.

Thus, in its simplest form as shown in FIG. 6, the practicing batter stands in the batter's box waiting for the pitch, his eyes trained to the pitcher's ball release point. As shown in FIGS. 4, 5 and 7, the pitch is on its way, and the batter's eyes are following the pitch to the strike zone, and the bat is being passed or swung through the strike zone and along the invisible target path ISP defined by the two dangling ends of the flexible members FM1, FM2 and, in the instance of FIG. 3, the upper end ball support of the batting "T". Remember, a major feature of the invention is that the practicing batter uses no baseball or other ball in practice. The basic fundamental idea is to train the batter to focus his eyes on the "ball" while holding his head stationary until contact and follow-through of the ball. At this point, the batter's head, eyes and body are positioned for the shortest amount of travel time to get to first base. Since the fundamental idea of the invention is for the batter to swing through an invisible optimized swing path, the invisible being defined by the space below the ends of the dangling flexible members and, when so used, the upper ball-free ball-supporting surface of a conventional batting "T".

Thus, there has been provided a batting training device and method in which a ground-engaging frame member has a pair of flexible members FM1, FM2 spaced apart and supported by the frame member to align, identify and to practice a delivery swing path. The flexible members FM1, FM2 have dangling ends which establish the upper boundary plane of an invisible batting target path ISP as well as an invisible swing path, whereby through repeated practice swings, the batter's head is physically and subliminally trained to stay virtually still allowing the needed time for the batter's eyes to see and stay on the ball, thereby instituting a necessary muscle memory for execution of the best swing.

While the invention has been described in relation to preferred embodiments of the invention, it will be appreciated that other embodiments, adaptations and modifications of the invention will be apparent to those skilled in the art.

What is claimed is:

1. A batter's training device comprising a ground-engaging frame member, a pair of flexible members supported by said frame member by a spaced-apart, predetermined distance to define a predetermined swing path, said flexible members having dangling ends which define an upper boundary plane of an invisible batting target path, wherein said pair of flexible dangling members are supported from said frame member by an elongated plastic tube member whereby through repeated practice swings, a batter's head is physically trained to stay virtually still to thereby establish muscle memory of a proper swing mechanics, wherein said frame member has a base that is horseshoe-shaped and an upper frame member which is swivel-mounted on said horseshoe-shaped member so that said frame member has a fall-away safety feature such that when a top portion of the upper frame member is struck accidentally by a bat, said upper frame member will spin and the batter's training device will fall backwards.

2. The batter's training device defined in claim 1 wherein said elongated plastic tube has ends, and said pair of flexible members is defined by a rope passing through said elongated plastic tube and having a pair of ends dangling from said ends of said elongated plastic tube.

3. A batter's training device comprising a ground-engaging frame member, a hollow tube supported by said frame member, said hollow tube having a predetermined length, a single flexible rope passing through said hollow tube member and having ends which project beyond the end of said hollow tube member, said ends dangling downwardly to define an upper boundary plane of an invisible batting target swing path, wherein said frame member has a base that is horseshoe-shaped and an upper frame member which is swivel mounted on said horseshoe-shaped member so that said frame has a fall-away safety feature such that when a top portion of said upper frame is struck accidentally by a bat, said upper frame member will spin and the batter's training device will fall backward.

4. The batter's training device defined in claim 3 wherein said dangling ends has height and including means for adjusting on said frame member to adjust the height of said dangling ends and thereby adjusting a height of said upper boundary plane of an invisible batting target swing path.

* * * * *